US011617445B2

(12) United States Patent
Wu

(10) Patent No.: US 11,617,445 B2
(45) Date of Patent: Apr. 4, 2023

(54) STRUCTURE FOR ADJUSTING SUPPORT FORCE OF LUMBAR PILLOW, AND CHAIR

(71) Applicant: Comfort Office Furniture Co., Ltd Guangdong, Guangzhou (CN)

(72) Inventor: Yao-Chuan Wu, Chiayi Hsien (TW)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 0 days.

(21) Appl. No.: 17/501,038

(22) Filed: Oct. 14, 2021

(65) Prior Publication Data

US 2022/0369816 A1 Nov. 24, 2022

(30) Foreign Application Priority Data

May 20, 2021 (CN) ..... 202121097316.9

(51) Int. Cl.
*A47C 7/44* (2006.01)
*A47C 7/46* (2006.01)

(52) U.S. Cl.
CPC ..... *A47C 7/462* (2013.01)

(58) Field of Classification Search
CPC ..... A47C 7/462
USPC ..... 297/284.4, 284.7
See application file for complete search history.

(56) References Cited

U.S. PATENT DOCUMENTS 4,730,871 A * 3/1988 Sheldon ..... A47C 7/462 297/284.7
5,449,219 A * 9/1995 Hay ..... B60N 2/666 297/284.7
5,567,010 A * 10/1996 Sparks ..... A47C 7/462 297/284.4
6,059,362 A * 5/2000 Lin ..... A47C 7/425 297/284.7
6,419,318 B1 * 7/2002 Albright ..... A47C 7/462 297/284.7
6,695,403 B1 * 2/2004 Su ..... A47C 5/06 297/284.7

(Continued)

FOREIGN PATENT DOCUMENTS

CN 108143159 A * 6/2018 ..... A47C 7/462
CN 109497751 A * 3/2019 ..... A47C 7/402

(Continued)

OTHER PUBLICATIONS

European search report and European search opinion dated May 11, 2022; EP 21208147.5.

*Primary Examiner* — Rodney B White
(74) *Attorney, Agent, or Firm* — IPro, PLLC

(57) ABSTRACT

A structure for adjusting a support force of a lumbar pillow includes: a back hugger body, a lumbar pillow, an elastic support, and a support adjustment mechanism; wherein a bottom of the back hugger body is hinged to a top of the lumbar pillow, and a back of the back hugger body is provided with a connection arm; one end of the elastic support is connected to a back of the lumbar pillow, and the other end of the elastic support is connected to a front side of the connection arm; and the support adjustment mechanism includes a slide block and a drive assembly connected to the slide block, wherein the slide block is slidably connected between the elastic support and the connection arm and is abutted against a back of the elastic support.

19 Claims, 6 Drawing Sheets

(56) References Cited

U.S. PATENT DOCUMENTS

| | | | | |
|---|---|---|---|---|
| 6,805,405 | B2 * | 10/2004 | Koo | A47C 7/465 297/284.7 |
| 6,938,956 | B1 * | 9/2005 | Piretti | A47C 7/38 297/284.7 |
| 6,981,743 | B2 * | 1/2006 | Edwards | A47C 7/402 297/284.7 |
| 8,272,691 | B2 * | 9/2012 | Hsuan-Chin | A47C 7/402 297/284.7 X |
| 8,690,249 | B2 * | 4/2014 | Kang | A47C 7/405 297/353 |
| 8,764,110 | B2 * | 7/2014 | Hsuan-Chin | A47C 7/44 297/284.7 |
| 9,596,941 | B1 * | 3/2017 | Romero | A47C 7/402 |
| 9,687,079 | B1 * | 6/2017 | Grove | A47C 7/445 |
| 10,455,946 | B1 * | 10/2019 | Wang | A47C 7/462 |
| 10,827,841 | B1 * | 11/2020 | Tsai | A47C 7/405 |
| 2004/0140701 | A1 * | 7/2004 | Schmitz | A47C 7/44 297/284.4 |
| 2005/0062323 | A1 * | 3/2005 | Dicks | A47C 7/402 297/284.4 |
| 2005/0189810 | A1 | 9/2005 | Wu | |
| 2007/0057550 | A1 | 3/2007 | Beyer | |
| 2008/0179930 | A1 * | 7/2008 | Harley | A47C 7/46 297/284.7 |
| 2009/0115235 | A1 * | 5/2009 | Bock | A47C 7/462 297/284.7 |
| 2009/0146476 | A1 * | 6/2009 | Kan | A47C 7/46 297/284.4 |
| 2019/0281988 | A1 * | 9/2019 | Su | A47C 7/46 |
| 2019/0313802 | A1 * | 10/2019 | Zhou | A47C 7/465 |
| 2021/0321778 | A1 * | 10/2021 | Matlin | A47C 3/0257 |
| 2022/0378211 | A1 * | 12/2022 | Wu | A47C 7/462 |

FOREIGN PATENT DOCUMENTS

| | | | | | |
|---|---|---|---|---|---|
| DE | 102008002974 | A1 | | 2/2010 | |
| KR | 1274582 | B1 | * | 6/2013 | A47C 7/462 |
| KR | 101296612 | B1 | * | 8/2013 | A47C 7/462 |
| WO | 2020003187 | A1 | | 1/2020 | |
| WO | WO-2020003187 | A1 | * | 1/2020 | A47C 7/462 |

* cited by examiner

STRUCTURE FOR ADJUSTING SUPPORT FORCE OF LUMBAR PILLOW, AND CHAIR

The present disclosure claims priority to Chinese Patent Application No. 202121097316.9, filed with the Chinese Patent Office on May 20, 2021, titled "STRUCTURE FOR ADJUSTING SUPPORT FORCE OF LUMBAR PILLOW, AND CHAIR", the entire contents of which are incorporated herein by reference.

TECHNICAL FIELD

Embodiments of the present disclosure relate to the technical field of chairs, and in particular, relate to a structure for adjusting a support force of a lumbar pillow, and a chair thereof.

BACKGROUND

Chairs are commonly used furniture in daily life. People who are accustomed to long-time sitting in the chair easily suffer from fatigue and soreness of back muscles or even lumbar spinal diseases. Therefore, the lumbar of the human body needs to be supported by a lumbar pillow of the chair, so as to reduce force applied to the lumbar.

At present, the lumbar pillow on the back of the chair is only capable of adjusting positions, for example, upward and downward position adjustment.

SUMMARY

In view of the above problem, embodiments of the present disclosure provide a structure for adjusting a support force of a lumbar pillow and a chair, to adjust a magnitude of the support force of the lumbar pillow for different users.

According to one aspect of the embodiments of the present disclosure, a structure for adjusting a support force of a lumbar pillow is provided. The structure includes: a back hugger body, a lumbar pillow, an elastic support, and a support adjustment mechanism; wherein a bottom of the back hugger body is hinged to a top of the lumbar pillow, and a back of the back hugger body is provided with a connection arm; one end of the elastic support is connected to a back of the lumbar pillow, and the other end of the elastic support is connected to a front side of the connection arm; and the support adjustment mechanism includes a slide block and a drive assembly connected to the slide block, wherein the slide block is slidably connected between the elastic support and the connection arm and is abutted against a back of the elastic support, the drive assembly is configured to drive the slide block to slide upward and downward along a vertical direction of the back hugger body to change a support position of the slide block on the elastic support.

In one optional embodiment, the drive assembly is a lead screw, and the slide block is provided with an inner screw hole mating with the lead screw; wherein the connection arm is provided with a mount, wherein a front side of the mount is successively provided with a fixing portion and a slide groove from top to bottom, the lead screw and the slide block are movably disposed in the slide groove, the lead screw and the mount are rotatably connected, an axial direction of the lead screw is consistent with the vertical direction of the back hugger body; and one end, facing away from the lumbar pillow, of the elastic support is provided with an abutting portion and a connection portion, wherein along a direction from the one end of the elastic support connected to the lumbar pillow to the other end of the elastic support, the abutting portion and the connection portion are successively connected, the connection portion is fixed to the fixing portion, the abutting portion is disposed opposite to the slide groove, and the slide block is abutted against a face, facing the slide groove, of the abutting portion.

In one optional embodiment, one end of the lead screw is further provided with a knob co-axial with the lead screw; and a movable opening allowing the knob to extend outside is disposed at a position, opposite to the knob, on a back of the mount.

In one optional embodiment, along a front-rear direction of the back hugger body, a thickness of the abutting portion progressively increases from the connection portion to the other end connected to the lumbar pillow.

In one optional embodiment, a face, facing the abutting portion, of the slide block and/or a face, facing the slide groove, of the slide block is provided with at least one protrusion, wherein the protrusion is configured to decrease a friction contact area between the slide block and the abutting portion, and/or decrease a contact area between the slide block and an inner wall of the slide groove.

In an optional embodiment, the elastic support is L-shaped or arc-shaped.

In one optional embodiment, the fixing portion is provided with a stop block, and the connection portion is provided with a stop opening, wherein the stop block mates with the stop opening; and the structure further includes a fixing member, wherein the fixing member is abutted against a side, facing away from the fixing portion, of the connection portion and is fixedly connected to the fixing portion.

In one optional embodiment, one end, facing away from the lumbar pillow, of the elastic support is provided with a first portion and a second portion in parallel, the abutting portion includes a first abutting portion and a second abutting portion, and the connection portion includes a first connection portion and a second connection portion, wherein the first connection portion and the first abutting portion are disposed on the first portion, and the second connection portion and the second abutting portion are disposed on the second portion; the stop block includes a first stop block and a second stop block that are disposed on the fixing portion, and the stop opening includes a first stop opening and a second stop opening, wherein the first stop opening is disposed in the first connection portion, the second stop opening is disposed in the second connection portion, the first stop block mates with the first stop opening, and the second stop block mates with the second stop opening; the fixing member is abutted against sides, facing away from the fixing portion, of the first connection portion and the second connection portion; and the inner screw hole is disposed in a middle portion of the slide block, and two ends of a face, facing away from the slide groove, of the slide block are respectively abutted against surfaces, facing towards the slide groove, of the first abutting portion and the second abutting portion.

In one optional embodiment, a bottom, on the mount, of the connection arm is provided with is a support portion connected to the bottom of the back hugger body, wherein the support portion is disposed between the first portion and the second portion.

According to another aspect of the embodiments of the present disclosure, a chair is provided. The chair includes the structure for adjusting the support force of the lumbar pillow as described above.

According to the embodiments of the present disclosure, the drive assembly drives the slide block to slide upward and downward between two ends on a side, facing away from the lumbar pillow, of the elastic support along a direction of the back hugger body, to change a support point of the slide block against the back of the elastic support, such that the magnitude of the support force of the lumbar pillow is adjusted based on needs, shapes, and the like of different users, and hence user experience is improved.

The above description only summarizes the technical solutions of the present disclosure. Specific embodiments of the present disclosure are described hereinafter to better and clearer understand the technical solutions of the present disclosure, to practice the technical solutions based on the disclosure of the specification and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference signs denote like parts. In the drawings.

Figure 1:
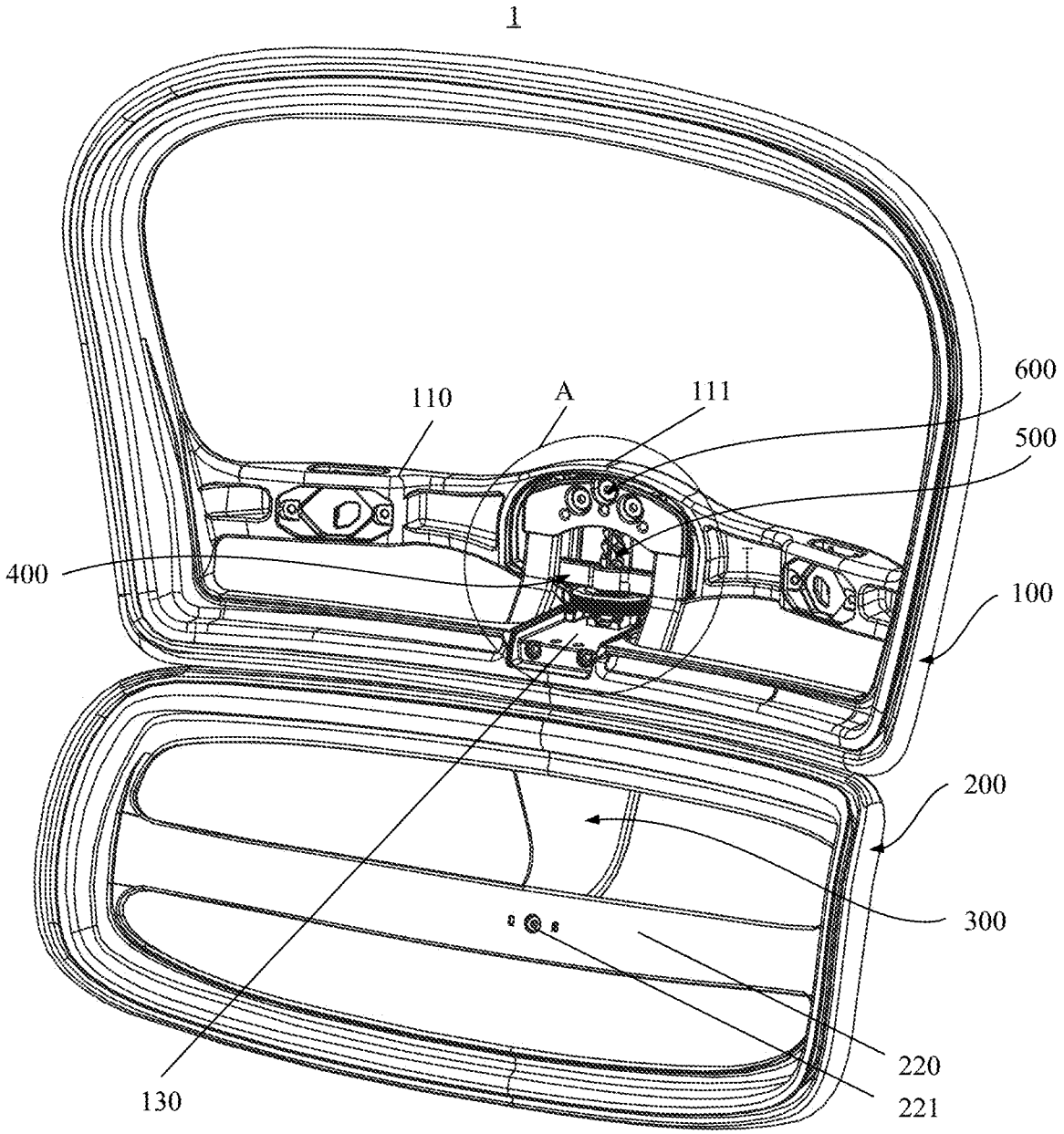
FIG. 1 is a schematic structural view of assembling of a structure for adjusting a support force of a lumbar pillow (with a seat cover removed) according to an embodiment of the present disclosure.

Reference numerals in the embodiments and denotations thereof:

Structure 1 for adjusting support force of lumbar pillow;

Back hugger body 100; connection arm 110; mount 111; fixing portion 112; first stop block 1121; second stop block 1122; slide groove 113; movable opening 114; stop groove 115; connection groove 120; support 130;

Lumbar pillow 200; hinge portion 210; support arm 220; first fixing position 221;

Elastic support 300; first portion 310; first connection portion 311; first stop opening 3111; first abutting portion 312; second stop opening 3211; second portion 320; second connection portion 321; second abutting portion 322; second fixing position 330;

Slide block 400; inner screw hole 410; protrusion 420; drive assembly 500; knot 510; fixing member 600; seat cover 700; and Chair 2; chair body 3; back support 4.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Figure 2:
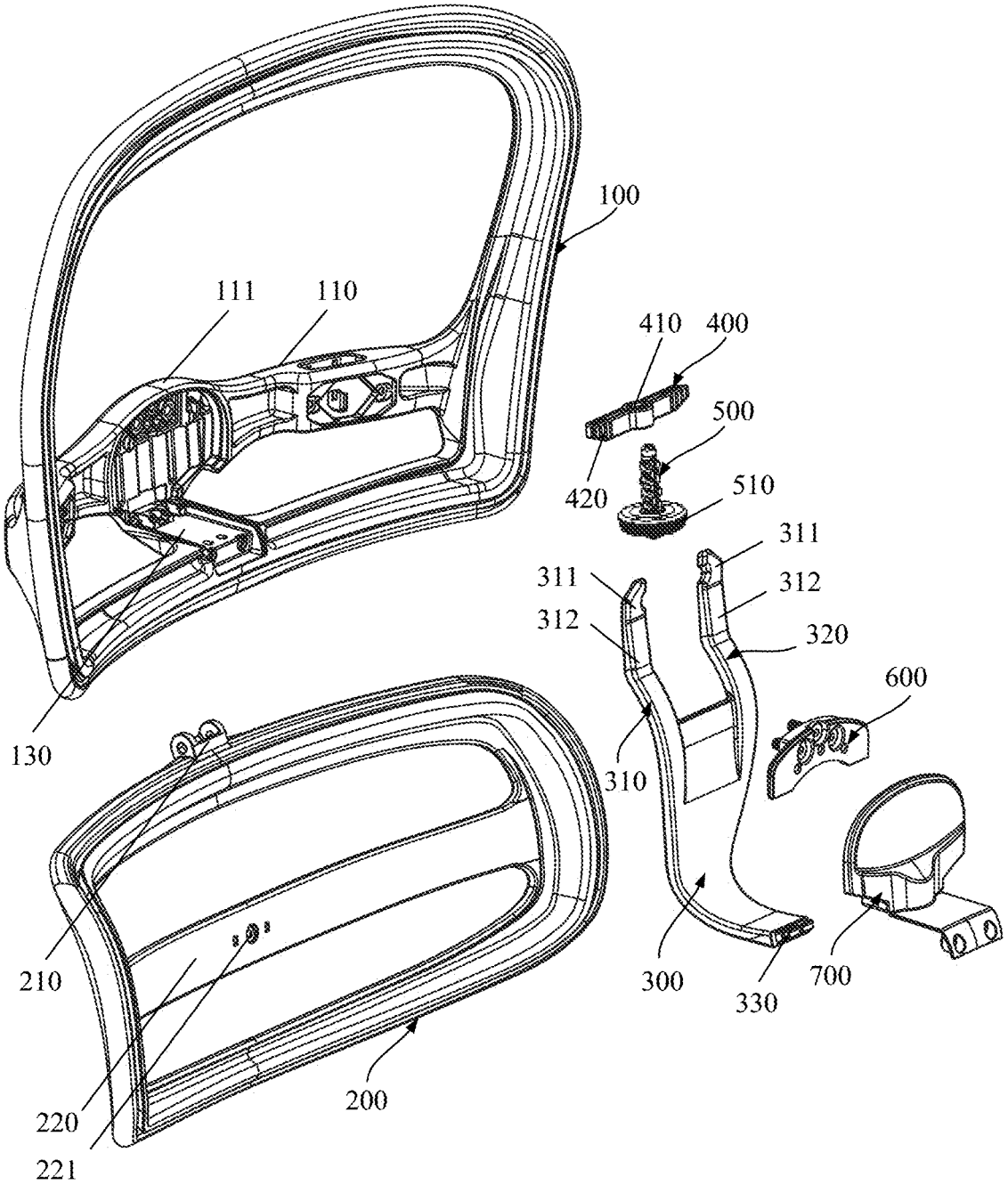
FIG. 2 is a schematic exploded structural view of the structure for adjusting the support force of the lumbar pillow according to an embodiment of the present disclosure.

Referring to FIG. 1 and FIG. 2, FIG. 1 is a schematic structural view of assembling of a structure for adjusting a support force of a lumbar pillow (with a seat cover 700 removed) according to an embodiment of the present disclosure; and FIG. 2 is a schematic exploded structural view of the structure for adjusting the support force of the lumbar pillow according to an embodiment of the present disclosure.

The structure 1 includes a back hugger body 100, a lumbar pillow 200, an elastic support 300, and a support adjustment mechanism. A bottom of the back hugger body 100 is hinged to a top of the lumbar pillow 200, and a back of the back hugger body 100 is provided with a connection arm 110. One end of the elastic support 300 is connected to a back of the lumbar pillow 200, and the other end of the elastic support 300 is connected to a front side of the connection arm 110. The support adjustment mechanism includes a slide block 400 and a drive assembly 500 connected to the slide block 400. The slide block 400 is slidably connected between the elastic support 300 and the connection arm 110, and the slide block 400 is abutted against a back of the elastic support 300. The drive assembly 500 is configured to drive the slide block 400 to slide upward and downward along a vertical direction of the back hugger body 100 to change a support position of the slide block 400 on the elastic support 300.

The back of the back hugger body 100, the back of the lumbar pillow 200, and the back of elastic support 300 refer to a side facing away from a human body when a person is normally seated on a chair. The vertical direction of the back hugger body 100 refers to a height direction of the chair when the chair is normally used. The elastic support 300 may be made of plastics, metals, or the like materials, which is not limited herein.

Since the slide block 400 is abutted against a position on a side, facing away from the lumbar pillow 200, between two ends of the elastic support 300, the elastic support 300 is equivalent to a lever, and the slide block 400 is equivalent to a fulcrum of the lever.

During use, in the case that the drive assembly 500 drives the slide block 400 to slide downward along the vertical direction of the back hugger body 100, the slide block 400 is abutted against the back of the elastic support 300 and slides towards one end, connected to the lumbar pillow 200, of the elastic support 300. As known from an equilibrium condition of the lever, a distance from the slide block 400 to the lumbar pillow 200 decreases, and thus a support force of the elastic support 300 against the lumbar pillow 200 increases. In the case that the drive assembly 500 drives the slide block 400 to slide upward along the vertical direction of the back hugger body 100, the distance from the slide block 400 to the lumbar pillow 200 increases, and thus the support force of the elastic support 300 against the lumbar pillow 200 decreases. In this way, the drive assembly 500 drives the slide block 400 to slide upward and downward between two ends on a side, facing away from the lumbar pillow 200, of the elastic support 300 along a direction of the back hugger body 100, to change a support point of the slide block 400 against the back of the elastic support 300, such that the magnitude of the support force of the lumbar pillow 200 is adjusted based on needs, shapes, and the like of different users, and hence user experience is improved.

Specifically, one end, facing away from the back hugger body 100, of the elastic support 300 may be fixed to a middle portion of the back of the lumbar pillow 200, or fixed to a bottom of the back of the lumbar pillow 200.

Exemplarily, the middle portion of the back of the lumbar pillow 200 is provided with a support arm 220. A middle portion of the support arm 220 is provided with a first fixing position 221. One end, facing away from the back hugger body 100, of the elastic support 300 is provided with a second fixing position 330. The first fixing position 221 and the second fixing position 330 are fixedly connected. Specifically, the first fixing position 221 and the second fixing position 330 may be fixedly connected by a screw, or by snap fitting, or the like fashions. In some embodiments, the elastic support 300 may be an L-shaped or arc-shaped structure, or may be a structure in other shapes.

Figure 3:
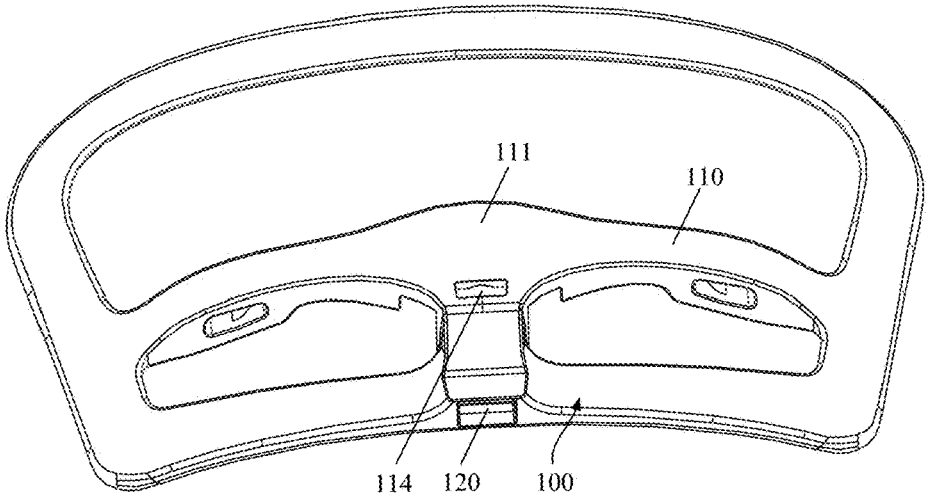
FIG. 3 is a schematic structural view, taken from a front-side view angle, of a back hugger body according to an embodiment of the present disclosure.

Referring to FIG. 3, in combination of FIG. 1 and FIG. 2, FIG. 3 is a schematic structural view, taken from a front-side view angle, of a back hugger body 100 according to an embodiment of the present disclosure. In some embodiments, the bottom of the back hugger body 100 is provided with a connection groove 120, and the top of the lumbar pillow 200 is provided with a hinge portion 210. The hinge portion 210 is disposed in the connection groove 120, and is rotatably connected to the back hugger body 100 by a pin shaft.

Figure 4:
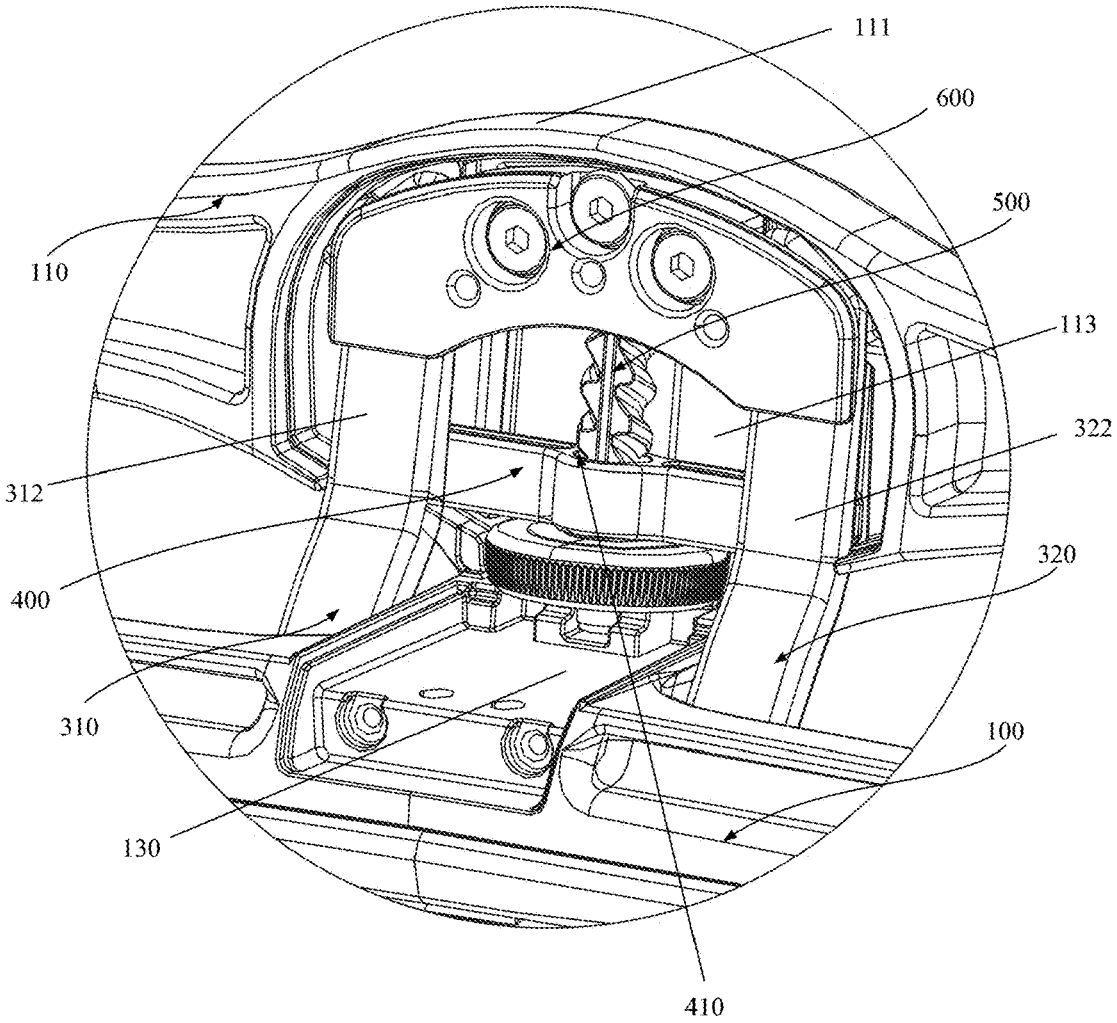
FIG. 4 is an enlarged view of portion A in FIG. 1.
Figure 5:
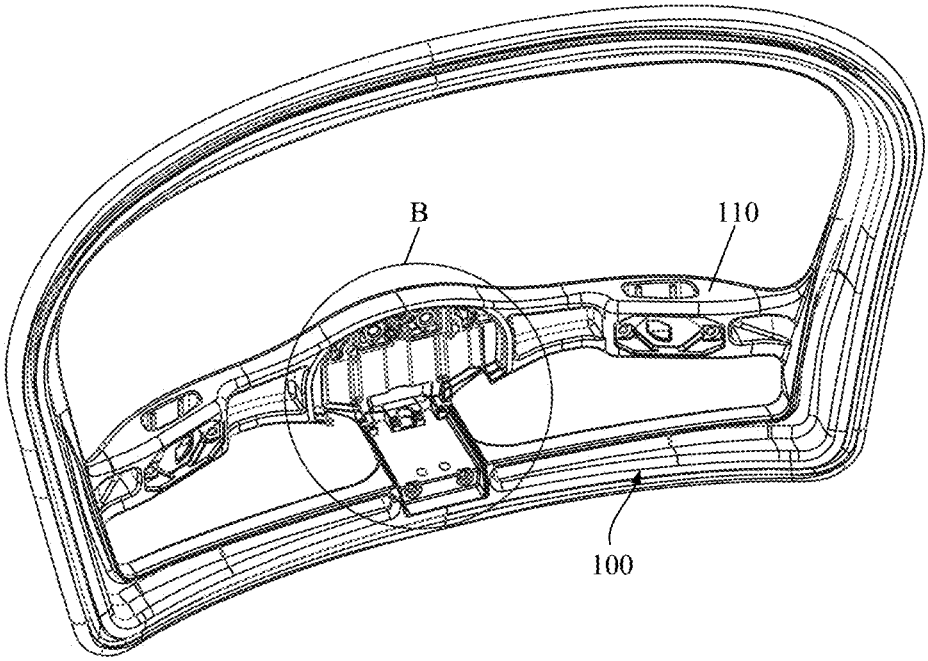
FIG. 5 is a schematic structural view, taken from a rear-side view angle, of the back hugger body according to an embodiment of the present disclosure.
Figure 6:
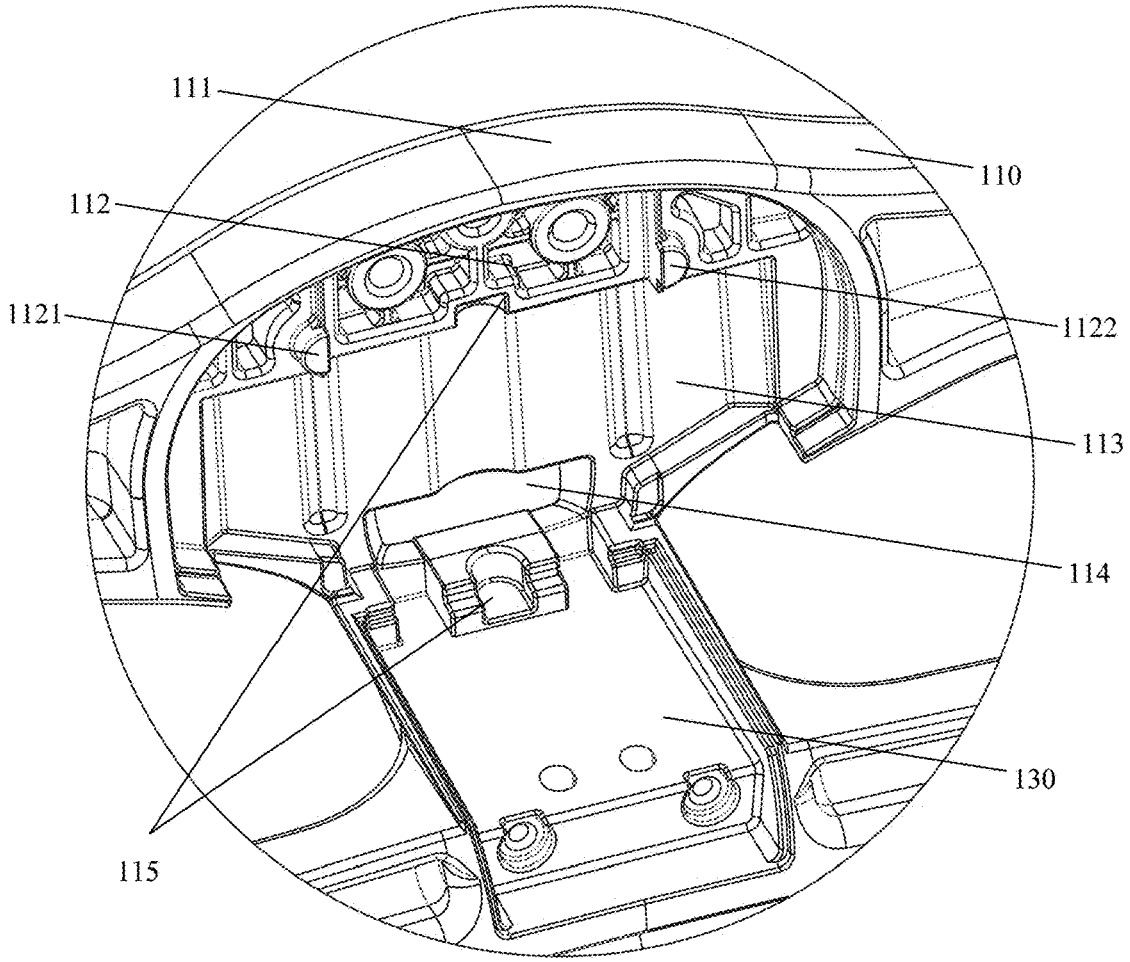
FIG. 6 is an enlarged view of portion B in FIG. 5.

Referring to FIG. 4 to FIG. 6, in combination of FIG. 1 and FIG. 2, FIG. 4 is an enlarged view of portion A in FIG. 1; FIG. 5 is a schematic structural view, taken from a rear-side view angle, of the back hugger body 100 according to an embodiment of the present disclosure; and FIG. 6 is an enlarged view of portion B in FIG. 5. In some embodiments, the drive assembly 500 is a lead screw, the slide block 400 is further provided with an inner screw hole 410 mating with the lead screw, and the connection arm 110 is provided with a mount 111. A front side of the mount 111 is successively provided with a fixing portion 112 and a slide groove 113 from top to bottom. The lead screw and the slide block 400 may be movably disposed in the slide groove 113, the lead screw is rotatably connected to the mount 111, and an axial direction of the lead screw is consistent with the vertical direction of the back hugger body 100. One end, facing away from the lumbar pillow 200, of the elastic support 300 is provided with an abutting portion and a connection portion, wherein along a direction from the one end of the elastic support 300 connected to the lumbar pillow 200 to the other end of the elastic support 300, the abutting portion and the connection portion are successively connected. The connection portion is fixed to the fixing portion 112, and the abutting portion is disposed opposite to the slide groove 113. The slide block 400 is abutted against a face, facing the slide groove 113, of the abutting portion.

A face, facing away from the abutting portion, of the slide block 400 may be in contact with an inner wall of the slide groove 113. The axial direction of the lead screw is an extending direction of a rotation axis of the lead screw, and the axial direction of the lead screw may be parallel to the vertical direction of the back hugger body 100.

In this embodiment, after the lead screw passes through the inner screw hole 410 of the slide block 400, the two ends of the lead screw are separately and rotatably connected to the mount 111. Since the axial direction of the lead screw is consistent with the vertical direction of the back hugger body 100, in the case that the lead screw is driven to rotate relative to the mount 111 (that is, the lead screw rotates relative to the back hugger body 100), the slide block 400 slides upward and downward along the axial direction of the lead screw. For example, in the case that the lead screw rotates clockwise relative to the back hugger body 100, the slide block 400 moves downward along the axial direction of the lead screw (at this time, the slide block 400 slides downward along the slide groove 113 relative to the back hugger body 100), and the slide block 400 is abutted against the back of the elastic support 300 and slides towards one end close to the lumbar pillow 200. In the case that the lead screw rotates counterclockwise relative to the back hugger body 100, the slide block 400 moves upward along the axial direction of the lead screw (at this time, the slide block 400 slides upward along the slide groove 113 relative to the back hugger body 100), the slide block 400 is abutted against the back of the elastic support 300 and slides along one end away from the lumbar pillow 200. That is, the lead screw converts its horizontal rotation movement into a movement of the slide block 400 sliding upward and downward along the back hugger body 100. In this method, the structure is simple and adjustment is convenient.

It should be noted that, in other embodiments, the lead screw may also be replaced with a push rod fixed to the slide block 400, wherein the push rod is slidably connected upward and downward to the connecting arm 110 of the back hugger body 100, and the up and down movement of the slide block 400 is achieved by pushing the push rod upward and downward. The push rod may be a manual push rod or an electric push rod.

In some embodiments, one end of the lead screw is further provided with a knob 510 co-axial with the lead screw, and a movable opening 114 allowing the knob 510 to extend outside is disposed at a position, opposite to the knob 510, on a back of the mount 111.

The movable opening 114 may be communicated with the slide groove 113. Configuration of the knob 510 brings about convenience for the user to rotate the knob 510 to drive the lead screw to rotate. Specifically, in the vertical direction of the back hugger body 100, the upper and lower side walls of the slide groove 113 are respectively provided with stop grooves 115 for sleeving onto the two ends of the lead screw, wherein the knob 510 is co-axial with the lead screw at the bottom end of the lead screw, the slide block 400 is sleeved on the lead screw through the inner screw hole 410, and is located above the knob 510. It may be understood that the knob 510 may also be co-axially fixed to the top end of the lead screw.

Figure 7:
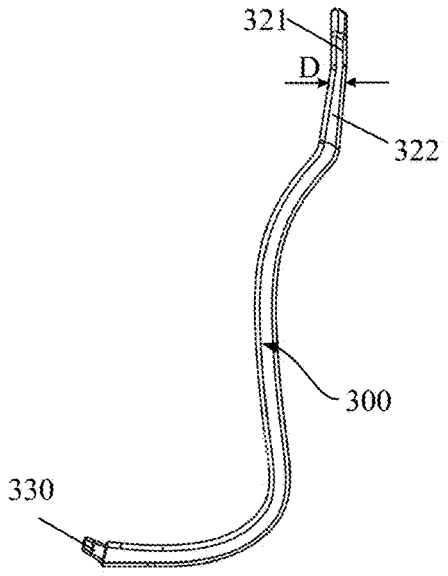
FIG. 7 is a schematic structural view, taken from a right-side view angle, of an elastic support according to an embodiment of the present disclosure.

Referring to FIG. 7, FIG. 7 is a schematic structural view, taken from a right-side view angle, of an elastic support 300 according to an embodiment of the present disclosure. Referring to FIG. 2 and FIG. 4, in some embodiments, along a front-rear direction of the back hugger body 100, a thickness D of the abutting portion progressively increases from the connection portion to the other end connected to the lumbar pillow 200. That is, a longitudinal sectional shape of the abutting portion is trapezoid structure which is smaller at the top and larger at the bottom. With this configuration, in the case that the slide block 400 slides upward and downward along the vertical direction of the back hugger body 100, a mutual squeezing force between the slide block 400 and the back of the elastic support 300 progressively increases, such that the elastic support 300 is capable of pushing the back of the lumbar pillow 200 to rotate about the bottom of the back hugger body 100 towards the front side thereof. In this way, the position of the lumbar pillow 200 is finely tuned, and thus the support force of the lumbar pillow 200 against the lumbar of a human body is increased.

In some embodiments, as illustrated in FIG. 2, a face, facing the abutting portion, of the slide block 400 and/or a face, facing the slide groove 113, of the slide block 400 is provided with at least one protrusion 420, wherein the protrusion 420 is configured to decrease a contact area between the slide block 400 and the abutting portion, and/or decrease a contact area between the slide block 400 and an inner wall of the slide groove 113. Preferably, a plurality of protrusions 420 are provided, for example, three, six, or the like.

In the case that a face, facing the abutting portion, of the slide block 400, is provided with a protrusion 420, the protrusion 420 may decrease the contact area between the slide block 400 and the abutting portion, such that friction sounds caused by relative sliding of the slide block 400 and the abutting portion are reduced in the case that the slide block 400 slides relative to the abutting portion, thereby preventing noise.

In the case that a face, facing the slide groove 113, of the slide block 400, is provided with a protrusion 420, the protrusion 420 may decrease the contact area between the slide block 400 and the inner wall of the slide groove 113, such that friction sounds caused by relative sliding of the slide block 400 and the slide groove 113 are reduced in the case that the slide block 400 slides relative to the slide groove 113, thereby preventing noise.

In the case that a face, facing the abutting portion, of the slide block 400 and a face, facing the slide groove 113, of the slide block 400 are each provided with a protrusion 420, the protrusions 420 may decrease the contact areas between the slide block 400 and the abutting portion and between the slide block 400 and the inner wall of the slide groove 113, such that friction sounds caused by relative sliding of the slide block 400 and the abutting portion and the slide groove 113 are reduced in the case that the slide block 400 slides relative to the abutting portion and the slide groove 113, thereby preventing noise.

It should be noted that one, two, or even a plurality of protrusions 420 may be provided, which is not limited herein. The protrusion 420 may be an elongated portion extending along the vertical direction. In this embodiment, by configuring the protrusion 420 on each of the face, facing the abutting portion, of the slide block 400 and the face, facing the slide groove 113, of the slide block, the noise generated by contact and friction is reduced in the case that the slide block 400 slides relative to the abutting portion and/or relative to the slide groove 113.

Still referring to FIG. 2 to FIG. 8, in some embodiments, the fixing portion 112 is provided with a stop block, and the connection portion is provided with a stop opening, wherein the stop block mates with the stop opening. The structure 1 for adjusting the support force of the lumbar pillow further includes a fixing member 600. The fixing member 600 is abutted against on a side, facing away from the fixing portion 112, of the connection portion, and the fixing member 600 is fixedly connected to the fixing portion 112.

The stop block is disposed in the stop opening, and cooperation between the stop block and the stop opening prevents the connection portion from moving upward and downward along the vertical direction of the back hugger body 100 and hence being detached from the fixing portion 112. The fixing member 600, by fixed connection to the fixing portion 112, presses tightly and fixes the connection portion to the fixing portion 112, such that one end, facing away from the lumbar pillow 200, of the elastic support 300 is fixed to the mount 111 of the connection arm 110.

Specifically, the fixing member 600 may be threaded to the fixing portion 112 by a screw. Nevertheless, the fixing member 600 may also be fixed to the fixing portion 112 by snap-fitting or the like detachable connection fashions.

Figure 8:
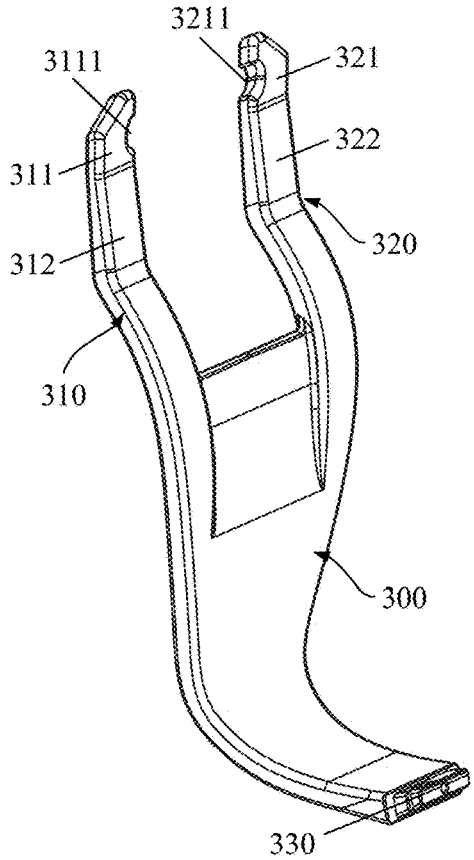
FIG. 8 is a schematic structural view of the elastic support according to an embodiment of the present disclosure.

Referring to FIG. 8, in combination with FIG. 2 to FIG. 6, in some specific embodiments, one end, facing away from the lumbar pillow 200, of the elastic support 300 is provided with a first portion 310 and a second portion 320 in parallel; the connection portion includes a first connection portion 311 and a second connection portion 321; and the abutting portion includes a first abutting portion 312 and a second abutting portion 322. The first connection portion 311 and the first abutting portion 312 are disposed on the first portion 310, and the second connection portion 321 and the second abutting portion 322 are disposed on the second portion 320.

The stop block includes a first stop block 1121 and a second stop block 1122 that are disposed in parallel on the fixing portion 112. That is, the first stop block 1121 and the second stop block 1122 are disposed in parallel on the fixing portion 112 along a widthwise direction of the back hugger body 100. The stop opening includes a first stop opening 3111 and a second stop opening 3211. The first stop opening 3111 is disposed in the first connection portion 311, and the second stop opening 3211 is disposed in the second connection portion 321. The first stop opening 3111 mates with the first stop block 1121, and the second stop opening 3211 mates with the second stop block 1122. That is, the first stop block 1121 is disposed in the first stop opening 3111, and the first stop block 1121 is disposed in the second stop opening 3211. The fixing member 600 is abutted against sides, facing away from the fixing portion 112, of the first connection portion 311 and the second connection portion 321, such that the first connection portion 311 and the second connection portion 321 are pressed tightly and fixed to the fixing portion 112.

The inner screw hole 410 is disposed in the middle portion of the slide block 400, and two ends of the face, facing away from the slide groove 113, of the slide block 410 are respectively abutted against faces, facing the slide groove 113, of the first abutting portion 312 and the second abutting portion 322.

Two first connection portions 311 are disposed in parallel on one end, facing away from the lumbar pillow 200, of the elastic support 300. That is, one end, close to the connection arm 110, of the elastic support 300 is U-shaped. The first connection portion 311 and the second connection portion 321 are both fixed to the fixing portion 112, and the first abutting portion 312 and the second abutting portion 322 are both disposed opposite to the slide groove 113.

In the case that the lead screw rotates and the slide block slides upward and downward, two ends of a face, facing away from the slide groove 113, of the slide block 400 are respectively abutted against, backs of the first abutting portion 312 and the second abutting portion 322, such that the support position of the slide block 400 on the back of the elastic support 300 is adjusted. In this way, the magnitude of the support force of the lumbar pillow 200 is adjusted.

In some embodiments, a bottom of the connection arm 110 on the mount 111 is provided with a support portion 130 connected to the bottom of the back hugger body 100. The support portion 130 is disposed between the first portion 310 and the second portion 320. With this configuration, the support portion 130 is capable of supporting the mount 111, which is favorable to improving a structural intensity of the mount 111.

In some embodiments, a front side of the mount 111 is further provided with a receiving recess. The slide groove 113 and the fixing portion 112 are both received in the receiving recess. A front side cover of the mount 111 is provided with a seat cover 700. The seat cover 700 is configured to cover an opening of the receiving recess, such that the slide block 400 supporting the structure 1, the lead screw, the knob 510 and the like parts are covered within the receiving recess and are prevented from being exposed outside.

The seat cover 700 may be fixed to the mount 111 by threaded connection via a screw, snap-fitting via a snap, or the like detachable connection fashions.

Figure 9:
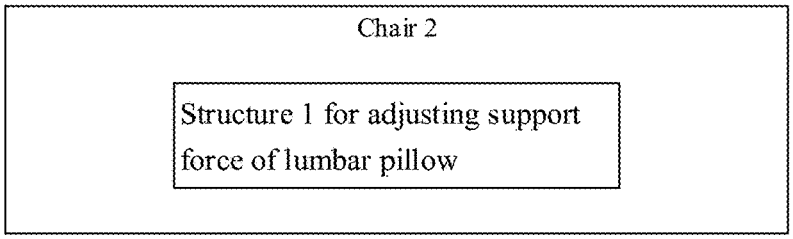
FIG. 9 is a schematic structural block diagram of a chair according to an embodiment of the present disclosure.
Figure 10:
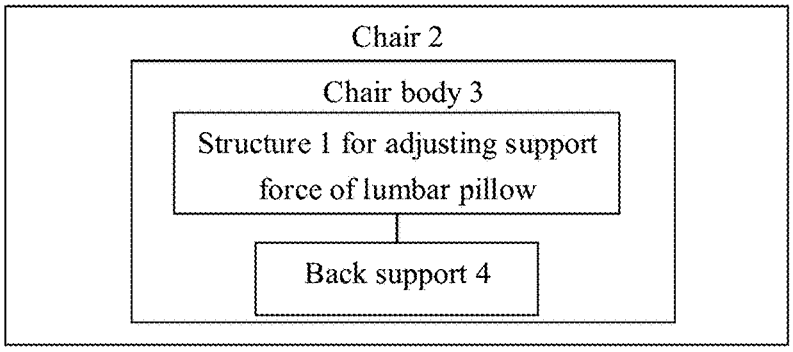
FIG. 10 is a schematic structural block diagram of a chair according to another embodiment of the present disclosure.

As illustrated in FIG. 9, another aspect of the present disclosure further provides a chair 2. The chair 2 includes the structure 1 for adjusting the support force of the lumbar pillow as described above. As illustrated in FIG. 10, specifically, the chair 2 further includes a chair body 3. The structure 1 for adjusting the support force of the lumbar pillow is mounted on a back support 4 of the chair body 3. The chair 2 according to this embodiment is capable of achieving the same beneficial effects as the structure 1 for adjusting the support force of the lumbar pillow, which are not described herein any further.

It should be noted that unless otherwise specified, the technical terms and scientific terms used in the embodiments of the present disclosure shall express general meanings that may be understood by a person skilled in the art.

In the description of the embodiments of the present disclosure, it should be understood that the technical terms "thickness," "upper," "lower," "front," "rear," "vertical," "horizontal," "top," "bottom," "inner," "outer," "clockwise," "counterclockwise," "axial," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "multiple" or "a plurality of" signifies at least two, unless otherwise specified.

In the description of the embodiments of the present disclosure, unless otherwise specified or defined, by defining that a first feature is arranged "above," or "below," or "beneath" a second feature, it means that the first feature is in direct contact with the second feature, or the first feature is in indirect contact with the second feature via an intermediate medium. In addition, by defining that a first feature is arranged "over," "above," and "under" a second feature, it means that the first feature is rightly over the second feature or is obliquely above the second feature, or the horizontal height of the first feature is greater than that of the second feature. In addition, by defining that a first feature is arranged "under," or "below," or "beneath" a second feature, it means that the first feature is rightly under the second feature or is obliquely below the second feature, or the horizontal height of the first feature is less than that of the second feature.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A structure for adjusting a support force of a lumbar pillow, comprising:

a back hugger body, a lumbar pillow, an elastic support, and a support adjustment mechanism; wherein a bottom of the back hugger body is hinged to a top of the lumbar pillow, and a back of the back hugger body is provided with a connection arm;

a first end of the elastic support is connected to a back of the lumbar pillow, and a second end of the elastic support is connected to a front side of the connection arm; and the support adjustment mechanism comprises a slide block and a drive assembly connected to the slide block, wherein the slide block is slidably connected between the elastic support and the connection arm and is abutted against a back of the elastic support, the drive assembly is configured to drive the slide block to slide upward and downward along a vertical direction of the back hugger body to change a support position of the slide block on the elastic support.

2. The structure according to claim 1, wherein the drive assembly is a lead screw, and the slide block is provided with an inner screw hole mating with the lead screw; wherein the connection arm is provided with a mount, wherein a front side of the mount is successively provided with a fixing portion and a slide groove from top to bottom, the lead screw and the slide block are movably disposed in the slide groove, the lead screw and the mount are rotatably connected, an axial direction of the lead screw is consistent with the vertical direction of the back hugger body; and the second end of the elastic support is provided with an abutting portion and a connection portion, wherein along a direction from the first end of the elastic support to the second end of the elastic support, the abutting portion and the connection portion are successively connected, the connection portion is fixed to the fixing portion, the abutting portion is disposed opposite to the slide groove, and the slide block is abutted against a face of the abutting portion facing the slide groove.

3. The structure according to claim 2, wherein one end of the lead screw is further provided with a knob co-axial with the lead screw; and a movable opening allowing the knob to extend outside is disposed at a position on a back of the mount and opposite to the knob.

4. The structure according to claim 3, wherein in the vertical direction of the back hugger body, the upper and lower side walls of the slide groove are respectively provided with stop grooves for sleeving onto two ends of the lead screw, wherein the knob is co-axial with the lead screw at bottom end of the lead screw, the slide block is sleeved on the lead screw through the inner screw hole, and is located above the knob.

5. The structure according to claim 2, wherein along a front-rear direction of the back hugger body, a thickness of the abutting portion progressively increases from the connection portion to the lumbar pillow.

6. The structure according to claim 2, wherein a first face of the slide block facing the abutting portion and/or a second face of the slide block facing the slide groove is provided with at least one protrusion, wherein the protrusion is configured to decrease a friction contact area between the slide block and the abutting portion, and/or decrease a contact area between the slide block and an inner wall of the slide groove.

7. The structure according to claim 2, wherein the elastic support is L-shaped or arc-shaped.

8. The structure according to claim 2, wherein the fixing portion is provided with a stop block, and the connection portion is provided with a stop opening, wherein the stop block mates with the stop opening; and the structure further comprises a fixing member, wherein the fixing member is abutted against a side of the connection portion away from the fixing portion, and fixedly connected to the fixing portion.

9. The structure according to claim 8, wherein the second end of the elastic support is provided with a first portion and a second portion in parallel, the abutting portion comprises a first abutting portion and a second abutting portion, and the connection portion comprises a first connection portion and a second connection portion, wherein the first connection portion and the first abutting portion are disposed on the first portion, and the second connection portion and the second abutting portion are disposed on the second portion;

the stop block comprises a first stop block and a second stop block that are disposed on the fixing portion, and the stop opening comprises a first stop opening and a second stop opening, wherein the first stop opening is disposed in the first connection portion, the second stop opening is disposed in the second connection portion, the first stop block mates with the first stop opening, and the second stop block mates with the second stop opening;

the fixing member is abutted respectively against a side of the first connection portion facing away from the fixing portion and a side of the second connection portion facing away from the fixing portion; and the inner screw hole is disposed in a middle portion of the slide block, and two ends of a face of the slide block facing away from the slide groove, are respectively abutted against a surface of the first abutting portion facing towards the slide groove and a surface of the second abutting portion facing towards the slide groove.

10. The structure according to claim 9, wherein a bottom, on the mount, of the connection arm is provided with is a support portion connected to the bottom of the back hugger body, wherein the support portion is disposed between the first portion and the second portion.

11. The structure according to claim 1, wherein the bottom of the back hugger body is provided with a connection groove, and the top of the lumbar pillow is provided with a hinge portion, wherein the hinge portion is disposed in the connection groove, and is rotatably connected to the back hugger body by a pin shaft.

12. The structure according to claim 1, wherein a middle portion of the back of the lumbar pillow is provided with a support arm, wherein a middle portion of the support arm is provided with a first fixing position, wherein the first end of the elastic support is provided with a second fixing position, wherein the first fixing position and the second fixing position are fixedly connected.

13. A chair, comprising a structure for adjusting a support force of a lumbar pillow;

wherein the structure for adjusting a support force of a lumbar pillow comprises:

a back hugger body, a lumbar pillow, an elastic support, and a support adjustment mechanism; wherein a bottom of the back hugger body is hinged to a top of the lumbar pillow, and a back of the back hugger body is provided with a connection arm;

a first end of the elastic support is connected to a back of the lumbar pillow, and a second end of the elastic support is connected to a front side of the connection arm; and the support adjustment mechanism comprises a slide block and a drive assembly connected to the slide block, wherein the slide block is slidably connected between the elastic support and the connection arm and is abutted against a back of the elastic support, the drive assembly is configured to drive the slide block to slide upward and downward along a vertical direction of the back hugger body to change a support position of the slide block on the elastic support.

14. The chair according to claim 13, wherein the chair further comprises a chair body, the structure for adjusting a support force of a lumbar pillow is mounted on a back support of the chair body.

15. The chair according to claim 13, wherein the drive assembly is a lead screw, and the slide block is provided with an inner screw hole mating with the lead screw; wherein the connection arm is provided with a mount, wherein a front side of the mount is successively provided with a fixing portion and a slide groove from top to bottom, the lead screw and the slide block are movably disposed in the slide groove, the lead screw and the mount are rotatably connected, an axial direction of the lead screw is consistent with the vertical direction of the back hugger body; and the second end of the elastic support is provided with an abutting portion and a connection portion, wherein along a direction from the first end of the elastic support to the second end of the elastic support, the abutting portion and the connection portion are successively connected, the connection portion is fixed to the fixing portion, the abutting portion is disposed opposite to the slide groove, and the slide block is abutted against a face of the abutting portion facing the slide groove.

16. The chair according to claim 15, wherein one end of the lead screw is further provided with a knob co-axial with the lead screw; and a movable opening allowing the knob to extend outside is disposed at a position on a back of the mount and opposite to the knob.

17. The chair according to claim 15, wherein along a front-rear direction of the back hugger body, a thickness of the abutting portion progressively increases from the connection portion to the lumbar pillow.

18. The chair according to claim 15, wherein a face of the slide block facing the abutting portion and/or a second face of the slide block facing the slide groove is provided with at least one protrusion, wherein the protrusion is configured to decrease a friction contact area between the slide block and the abutting portion, and/or decrease a contact area between the slide block and an inner wall of the slide groove.

19. The chair according to claim 15, wherein the elastic support is L-shaped or arc-shaped.

* * * * *